US010458411B2

(12) United States Patent
De Kerpel

(10) Patent No.: US 10,458,411 B2
(45) Date of Patent: Oct. 29, 2019

(54) COMPRESSOR DEVICE AND A COOLER THEREBY USED

(71) Applicant: ATLAS COPCO AIRPOWER, NAAMLOZE VENNOOTSCHAP, Wilrijk (BE)

(72) Inventor: Stefan Paul M. De Kerpel, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 179 days.

(21) Appl. No.: 15/311,361

(22) PCT Filed: May 4, 2015

(86) PCT No.: PCT/BE2015/000017
§ 371 (c)(1),
(2) Date: Nov. 15, 2016

(87) PCT Pub. No.: WO2015/172206
PCT Pub. Date: Nov. 19, 2015

(65) Prior Publication Data

US 2017/0074268 A1 Mar. 16, 2017

(30) Foreign Application Priority Data

May 16, 2014 (BE) ..... 2014/0370

(51) Int. Cl.
*F04C 29/04* (2006.01)
*F04D 29/58* (2006.01)
(Continued)

(52) U.S. Cl.
CPC ..... *F04C 29/04* (2013.01); *F04C 18/16* (2013.01); *F04D 29/5826* (2013.01); *F28D 7/1607* (2013.01); *F28F 9/0202* (2013.01)

(58) Field of Classification Search
CPC .. F04C 29/04; F04D 25/5826; F04D 25/5833; F28D 21/0001; F02C 6/18; F02C 7/143; F04B 25/00; F25B 2400/072
See application file for complete search history.

(56) References Cited

U.S. PATENT DOCUMENTS

2005/0235625 A1 10/2005 Gericke et al.
2012/0222549 A1 9/2012 Vermeer
(Continued)

FOREIGN PATENT DOCUMENTS

CN 103363822 A 10/2013
DE 1551523 A1 3/1970
(Continued)

OTHER PUBLICATIONS

International Search Report (ISR) dated Feb. 26, 2016, for PCT/BE2015/000017.
(Continued)

*Primary Examiner* — Kenneth J Hansen
(74) *Attorney, Agent, or Firm* — Bacon & Thomas, PLLC

(57) ABSTRACT

A compressor device with at least two compressor elements connected in series and at least two coolers of which there at least two split coolers that are split in separate successive stages, respectively a hot stage and a cold stage, that are connected together in one or more separate cooling circuits such that the compressed gas is cooled sufficiently between the compressor elements with a minimum coolant flow rate to keep the temperature of the cooled gas at the outlet of each cooler below a maximum permissible value and thereby to realize a desired temperature increase of the coolant in at least one of the aforementioned cooling circuits.

10 Claims, 11 Drawing Sheets

(51) Int. Cl.

| | |
|---|---|
| ***F28D 7/16*** | (2006.01) |
| ***F04C 18/16*** | (2006.01) |
| ***F28F 9/02*** | (2006.01) |

(56) References Cited

U.S. PATENT DOCUMENTS

| | | | |
|---|---|---|---|
| 2012/0291434 | A1 | 11/2012 | Janssens |
| 2013/0047661 | A1 | 2/2013 | Janssens et al. |

FOREIGN PATENT DOCUMENTS

| | | | |
|---|---|---|---|
| JP | S56-13607 U | | 2/1981 |
| JP | S56 33489 | * | 4/1981 |
| JP | S56-33489 U | | 4/1981 |
| JP | S6234147 Y | | 8/1987 |

OTHER PUBLICATIONS

International Preliminary Report on Patentability (IPRP) dated Jun. 29, 2016, for PCT/BE2015/000017.

* cited by examiner

COMPRESSOR DEVICE AND A COOLER THEREBY USED

The present invention relates to a compressor device.

More specifically the invention concerns a compressor device for compressing gas in two or more stages, whereby this compressor device comprises at least two compressor elements connected in series and at least two coolers for cooling the compressed gas, i.e. an intercooler between each of two successive compressor elements and, if need be depending on the configuration, an aftercooler downstream from the last compressor element, whereby each cooler is provided with a primary section through which the compressed gas to be cooled is guided and a secondary section that is in heat-exchanging in contact with the primary section and through which coolant is guided.

BACKGROUND OF THE INVENTION

It is known that a gas that is compressed in a compressor element undergoes a substantial temperature increase.

For compressor devices with a number of stages, as referred to here, the compressed gas is supplied from a compressor element to a subsequent compressor element.

It is known that the compression efficiency of a multistage compressor is highly dependent on the temperature at the inlet of each compressor element of this multistage compressor and that the lower the inlet temperature of the compressor elements, the better the compression efficiency of the compressor.

That is why it is known to use intercoolers between two successive compressor elements to ensure maximum cooling and to obtain the highest possible compression efficiency.

It is also known to cool the compressed gas after the last compressor element before the gas is supplied to the consumer network because otherwise damage could occur to the consumers in the network on account of too high temperatures.

With the known compressor devices with a number of stages, the cooling, and more specifically the coolers, are generally attuned for maximum cooling for the purpose of maximum compression efficiency, whereby an available coolant, generally water, is driven from a cold source through the coolers in parallel so that each cooler receives coolant at the same cold temperature for maximum cooling.

Such a parallel supply of the coolers is highly suitable for optimum compression efficiency but requires a relatively high coolant flow rate for a sufficient supply of coolant to each cooler, which has the disadvantage that such a parallel supply is not optimum with regard to the required pumping power and size of the required cooling circuit and coolers.

Another disadvantage is that the flow rate of the coolant that flows through the coolers must be kept relatively high to bring about maximum cooling, such that the temperature of the coolant when leaving the compressor device is relatively low and as a result is poorly suited for recovering heat therefrom, for example in the form of the provision of hot water or similar.

Moreover, a high flow rate of the coolant also results in high investment costs, high operating costs and high maintenance costs of the cooling installation. Indeed, the heated coolant must be cooled in its turn in an air-water heat exchanger for example, whose dimensioning is highly dependent on the flow rate of the coolant and additives are also added to the cooling water to prevent limescale, counteract corrosion and inhibit bacterial growth.

For the purpose of better heat recovery it could be chosen to reduce the flow rate that is driven in parallel through the coolers and thereby increase the temperature of the coolant at the output, but this would be at the expense of the cooling and thus the compression efficiency.

SUMMARY OF THE INVENTION

The purpose of the present invention is to provide a solution to the aforementioned and other disadvantages by placing less emphasis on the compression efficiency and rather considering the cooling from the perspective of finding an optimum combination of high compression efficiency, good possibility of heat recovery, and minimising the costs of the cooling installation; or from the perspective of an optimum combination of two of the three objectives stated above, depending on the application.

To this end the invention concerns a compressor device for compressing gas in two or more stages, whereby this compressor device comprises at least two compressor elements connected in series and at least two coolers for cooling the compressed gas, i.e. an intercooler between each of two successive compressor elements, and if need be depending on the configuration, an aftercooler downstream from the last compressor element, whereby each cooler is provided with a primary section through which the compressed gas to be cooled is guided and a secondary section that is in heat-exchanging contact with the primary section and through which coolant is guided, with the characteristic that at least two of the aforementioned coolers are 'split coolers' whose secondary section is split into at least two separate stages to cool the gas that is guided through the primary section in successive stages, respectively at least a hot stage for a first cooling of the hot gas that flows into the primary section of the cooler and a cold stage for the further cooling of this gas, whereby the stages of the secondary sections of the coolers are connected together in one or more separate cooling circuits such that the compressed gas between the compressor elements is sufficiently cooled, with a minimum coolant flow rate through the cooling circuits, to keep the temperature of the cooled gas at the outlet of each cooler below a maximum permissible value and thereby to realise a desired temperature increase of the coolant in at least one of the aforementioned cooling circuits.

With a compressor device according to the invention the cooling in the coolers is split into two stages as it were, whereby through a suitable choice of the order in which the coolant or coolants are driven through the stages, a minimum cooling capacity is required that ensures that each cooler provides sufficient cooling so as not to cause any problems in the subsequent compressor element without the best compression efficiency necessarily being aimed for, which also leads to higher temperatures being able to be realised in the coolant that enable better energy recovery. The hot stage thereby ensures a large increase of the temperature of the coolant in particular, while the cold stage primarily guarantees the lowest possible outlet temperature of the gas to be cooled.

In this way a desired temperature increase can be aimed for that is at least of the order of magnitude of 30° C. or, if greater heat recovery is required, at least of the order of magnitude of 40° C. or even higher, for example of the order of magnitude of 50° C.

For example, in the first instance in the design of the compressor device with a certain configuration of compressor elements and coolers, at least two or more of the cold stages of the secondary sections of the coolers are connected together in series in a cooling circuit through which a coolant is guided.

Due to the serial connection of at least two of the cold stages, sufficient cooling can nonetheless be realised in the successive coolers with a relatively limited coolant flow rate.

The required coolant flow rate can be attuned to the highest possible temperature of the compressed gas at the inlet of a compressor element for example, taking account for example of the maximum permissible temperature for the good operation of the compressor element, for example the temperature at which the operation of a turbocompressor becomes unstable on account of the occurrence of the 'surge' phenomenon or the max outlet temperature of a screw compressor to prevent damage to the coating of the screws.

Hereby the coolant is preferably first guided through the cold stage of this cooler in which by design the temperature of the compressed gas at the outlet of the cooler concerned is the closest to the maximum permissible temperature at the inlet of the compressor stage immediately following it.

Preferably in the first design phase at least two, preferably at least three, of the hot stages of the secondary sections of the coolers are connected together in series in a cooling circuit through which a coolant is guided, whereby in particular the coolant is lastly guided through the hot stage of the cooler immediately following the compressor stage that has the highest outlet temperature by design.

In the most preferred embodiment of a compressor device according to the invention at least two, preferably all, cold stages of the secondary sections of the coolers and at least two, preferably all, hot stages of the secondary sections of the coolers are connected together in series in a cooling circuit through which a coolant is guided, whereby the coolant is first guided through the cold stages and then through the hot stages in this cooling circuit.

Depending on the intended configuration of the compressor device it can be chosen to connect the stages of the coolers together for two or more separate cooling circuits, whereby one cooling circuit can be used to obtain the highest possible outlet temperature of the coolant for the purpose of maximum heat recovery, while the other cooling circuit can be used to primarily ensure a sufficiently low outlet temperature of the gas to be cooled in the intercoolers.

The invention also relates to a cooler for use in a compressor device according to any one of the previous claims, whereby this cooler has a modular composition in such a way that it is configurable as a split or non-split cooler.

Preferably it concerns a cooler in the form of a tube cooler with a tube bundle to guide a coolant through it, whereby this tube bundle is affixed in a housing with a shell that shuts off the tube bundle at the ends of the tubes by endplates through which the tubes protrude, whereby this housing forms a channel to guide a gas to be cooled over and around the tubes, whereby the tube bundle is covered at its ends by a cover with partitions that divide the cover into compartments that cover over one or more ends of the tubes for channelling the coolant through these tubes, whereby these partitions are provided with a seal between the partition and an aforementioned endplate to separate the flow in the mutual compartments, whereby at least two separating partitions can be provided with such a seal that is removable and which in its presence splits the tube bundle into two separate channels for a coolant to form a split cooler, and in its absence forms an interconnection between these two channels to form one continuous channel to form a single non-split cooler.

In this way such a cooler according to the invention can be converted from a conventional single cooler into a split double cooler according to the invention by simply fitting or removing seals.

According to a practical embodiment the separating partitions are straight partitions that provide the advantage that they are easy to realise.

Preferably two identical covers are used, whereby each cover is provided with an input and an output that are both located on the same side of an aforementioned separating partition, or with two inputs or two outputs for a coolant that are located on either side of the aforementioned separating partition.

Thus only one type of cover is needed that can be used for both the construction as a split cooler for two coolants and for the construction of a non-split cooler for only one coolant, whereby in that case one input and one output are plugged.

BRIEF DESCRIPTION OF THE DRAWINGS

With the intention of better showing the characteristics of the invention, a few preferred embodiments of a compressor device according to the invention and a cooler applicable therewith are described hereinafter by way of an example, without any limiting nature, with reference to the accompanying drawings, wherein.

DETAILED DESCRIPTION OF THE INVENTION

Figure 1:
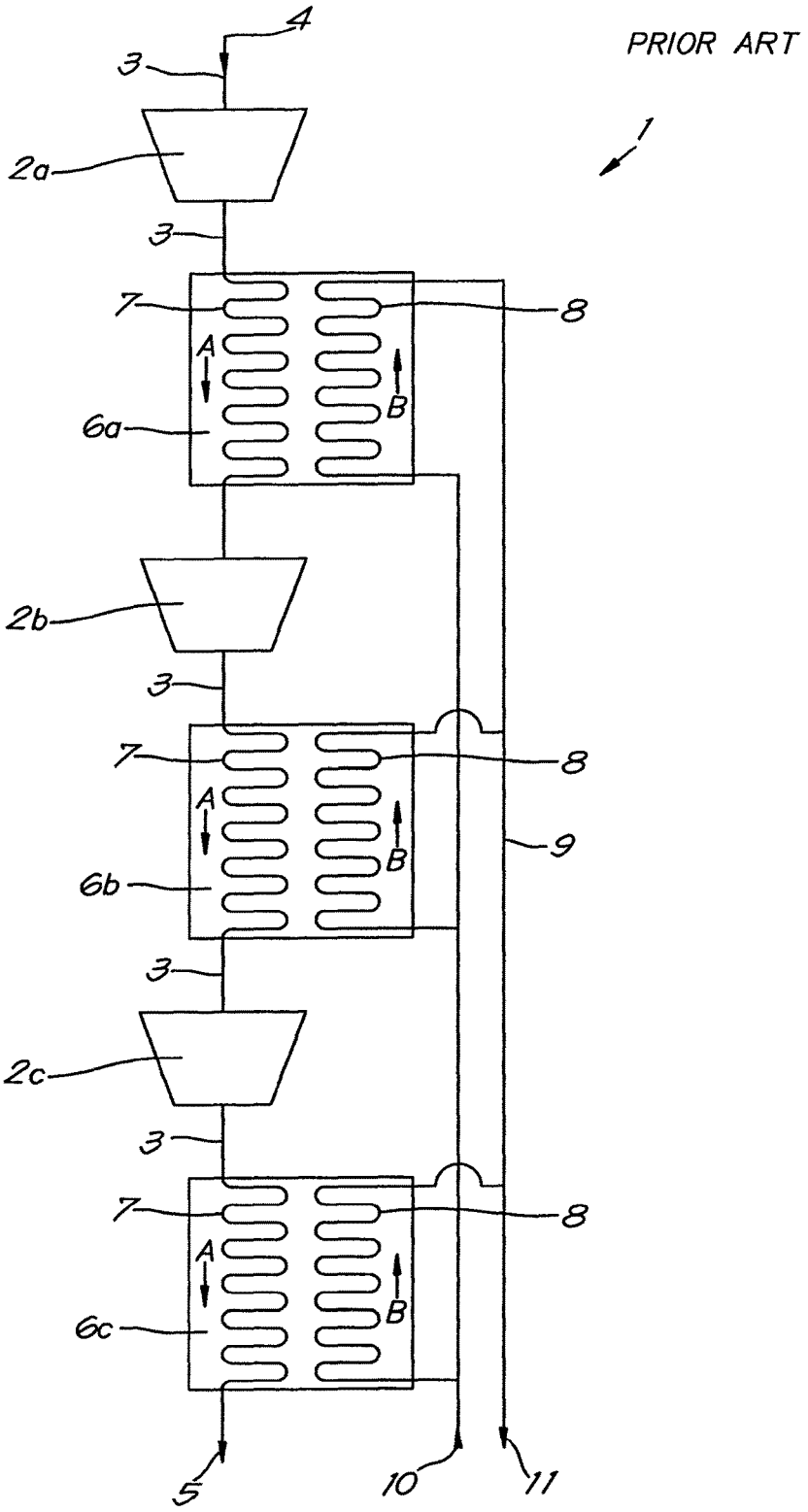
FIG. 1 schematically shows a compressor device according to the state of the art.

FIG. 1 shows a conventional compressor device 1 according to the state of the art with three compressor elements 2, respectively 2*a*, 2*b* and 2*c*, which are connected together in series between an inlet 4 and an outlet 5 by means of pipes 3.

Downstream from each compressor element 2 there is a cooler for cooling the compressed gas, respectively an 'intercooler' 6*a* between the compressor elements 2*a* and 2*b*, an intercooler 6*b* between the compressor elements 2*b* and 2*c*, and an 'aftercooler' 6*c* after the last compressor element 2*c*.

The intercoolers 6*a* and 6*b* are thereby intended to cool to a maximum the temperature of the compressed gas from a previous compressor element 2 before being drawn in by a subsequent compressor element 2, and this is to ensure that the efficiency of the compression in the compressor is optimum.

The aftercooler 6*c* ensures cooling of the compressed gas before it leaves the compressor device 1 according to the invention via the outlet 5, and this to prevent damage to the connected consumers.

Each cooler 6 is provided with a primary section 7 through which the compressed gas to be cooled is guided, as shown by the arrows A, and a secondary section 8 that is in heat-exchanging contact with the primary section 7 and through which the coolant is guided in the opposite direction, as shown by the arrows B.

The compressor device 1 is provided with a single cooling circuit 9 with an input 10 and an output 11.

With the conventional compressor device of FIG. 1 the coolant is guided through the cooling circuit 9 in parallel through the secondary sections 8 of the coolers 6, whereby the coolant supply is thus distributed over the three coolers 6 and whereby each cooler 6 thus receives coolant with the same input temperature.

The cooling circuit 9 is calculated to realise a maximum compression efficiency with maximum cooling in each intercooler 6*a* and 6*b*. With a conventional compressor device typically one or more heat-exchanging components are connected to the cooling circuit, such as an oil cooler or a connection to a cooling circuit of a motor. Generally their share of the total heat-exchanging capacity of the cooling circuit is relatively small.

A disadvantage of such a device is that the maximum cooling also requires a high available flow rate of the coolant and thus associated high investment costs, operating costs and maintenance costs of the cooling circuit 9.

Another characteristic is that the temperature of the coolant at the output 11 is relatively low and consequently difficult to use for other applications or for recovering energy therefrom.

Figure 2:
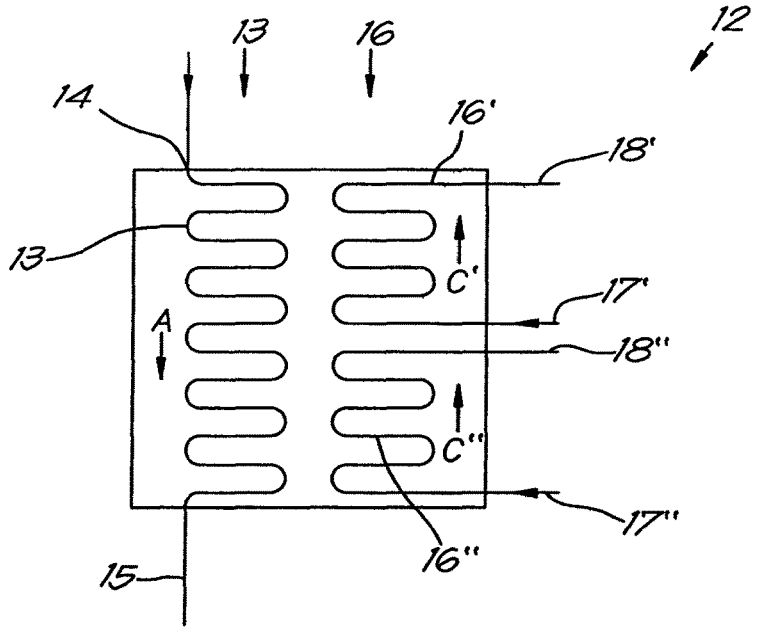
FIGS. 2 and 3 show a diagram of two variants of split coolers according to the invention.
Figure 3:
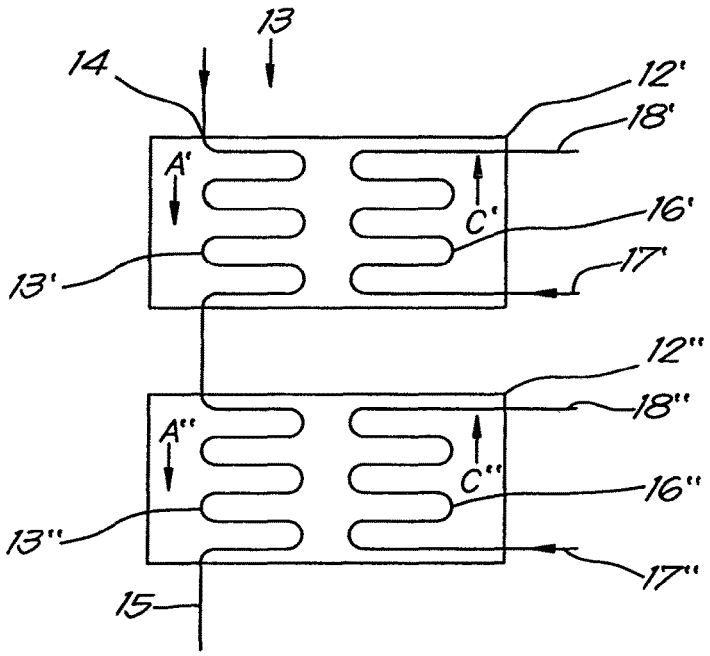

A cooling circuit according to the invention differs from the parallel connection described above and makes use of 'split coolers' 12, as shown in FIGS. 2 and 3.

The split cooler 12 according to FIG. 2 comprises a primary section 13, just as with a conventional cooler 6, with an input 14 and output 15 for compressed gas, and a secondary section 16, which in this case, contrary to a conventional cooler 6, is split into two separate stages 16' and 16", each with a separate input 17 and output 18 to drive a coolant through it in the opposite direction to the compressed gas, in the direction of the arrows C' and C".

In this way the cooling of the compressed gas by the coolant is split into two successive stages 16' and 16", i.e. a 'hot stage' 16' for a first cooling of the hot gas that flows into the primary section 13 via the input 14, and a 'cold stage' 16" for further cooling the gas before this further cooled gas leaves the primary section 13 via the output 15.

An alternative of a split cooler 12 is shown in FIG. 3, whereby in this case the cooler 12 is split into two subcoolers 12' and 12", whereby in this case the primary section 13 is also split into two stages 13' and 13" that are connected together in series to form one continuous primary section as it were.

Figure 4:
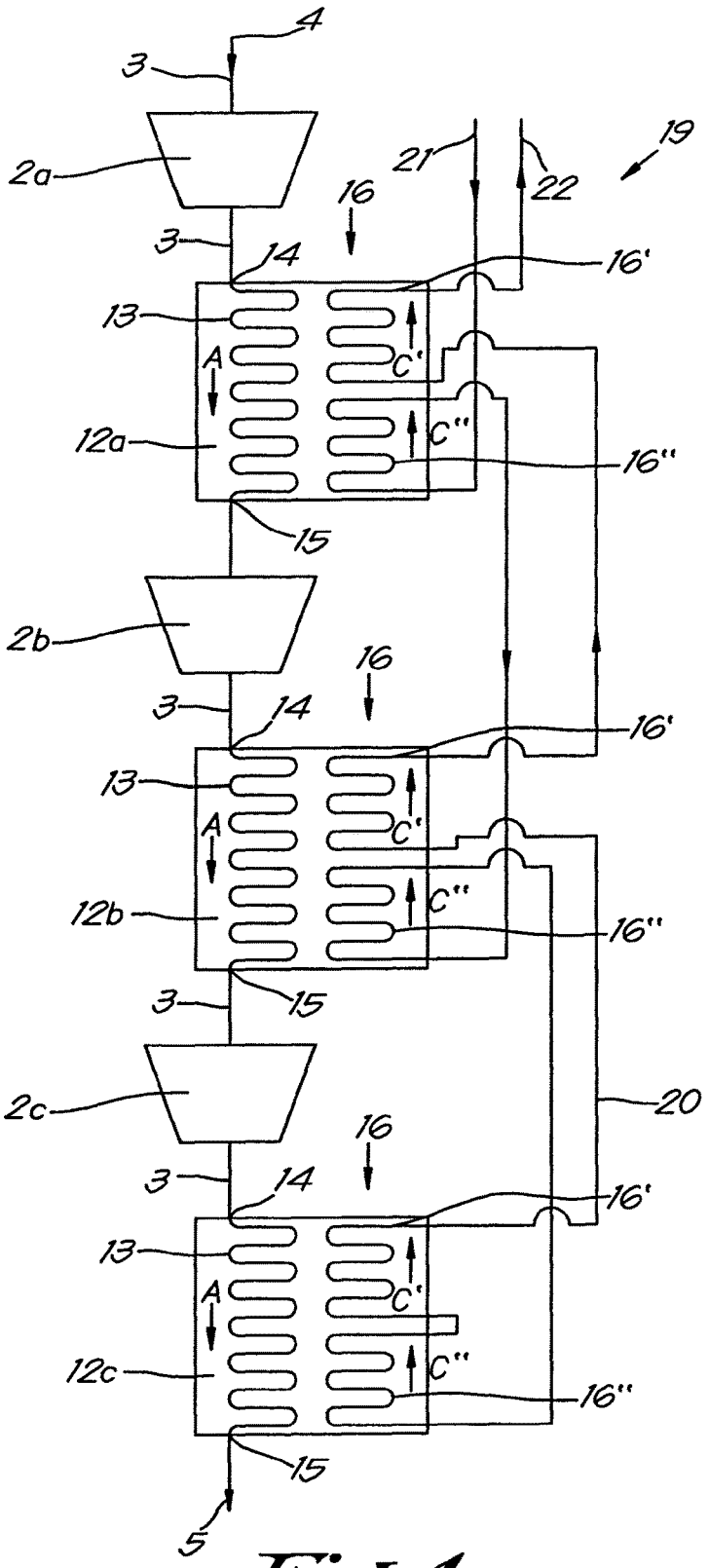
FIG. 4 shows a diagram such as that of FIG. 1, but for a compressor device according to the invention with coolers such as those of FIG. 2.

The compressor device 19 according to the invention shown in FIG. 4 differs from the conventional device 1 of FIG. 1 by the single coolers 16 being replaced by split coolers 12 such as those of FIG. 2, whereby the secondary sections 16' and 16" are incorporated into one single cooling circuit 20 with an input 21 and output 22 for the coolant.

The cooling circuit 20 is designed such that the coolant is guided in series successively through all stages 16' and 16" of the secondary sections 16 of the coolers 12 in a certain order that is a function of the configuration of the compressor device 19 and the intended purpose.

In the case of FIG. 4 the coolant is first guided through the cold stages 16" of the coolers 12 in the same order with respect to the flow of the gas, whereby in other words the coolant is first driven through the intercooler 12*a* and then in order through the second intercooler 12*b* and aftercooler 12*c*.

Then the coolant is guided successively through the hot stages 16', this time in the reverse order to the order in which the gas flows through the coolers 12, thus first through the aftercooler 12*c*, then through the second intercooler 12*b*, and then through the first intercooler 12*a*.

In this way it is ensured that all coolers 12 cool sufficiently to keep the temperature of the cooled gas at the output 15 of each cooler 12 below the imposed maximum value that takes account of a minimum control margin and the occurrence of possible damaging consequences for example for the downstream section of the compressor device if this maximum temperature is exceeded, without necessarily being concerned with optimising the efficiency of the compressor device 19.

In other words higher temperatures of the gas that is drawn in by the compressor elements 2*b* and 2*c* are allowed than would be required for an optimum efficiency of these compressor elements 2*b* and 2*c*.

This enables lower coolant flow rates to be provided than in the case of a conventional compressor device 1 such as that of FIG. 1, which benefits the cost and complexity of the cooling circuit 20.

Moreover, in this way a higher temperature increase of the coolant can also be realised between the input 21 and the output 22 of the cooling circuit 20. As a result heat can be recovered more efficiently than in the case of a conventional compressor device 1.

By design the cooling circuit can be dimensioned for example, such that a desired temperature increase of the coolant is obtained that is of the order of magnitude of 30° C., better still at least of the order of magnitude of 40° C., or preferably even greater than 50° C. depending on the desire of the user in order to be able to utilise hot cooling water for example.

Preferably the coolant is first guided through the cold stage 16" of the cooler 12 immediately prior to the compressor element 2, which by design needs the lowest inlet temperature. In the example of FIG. 4 this is the second compressor element 2*b* and the immediately preceding intercooler 12*a*.

This criterion for determining the order in which the coolant is driven through the coolers 12 also applies to every combination of two stages. This means that in the case of FIG. 4 the coolant is then guided through the stage 16" of the cooler 12*b* immediately prior to the compressor element 2*c* with the second lowest desired inlet temperature, etc.

After going through the cold stages 16" then preferably the coolant is lastly guided through the hot stage 16' of the cooler 12 immediately following the compressor element 2, which by design has the highest outlet temperature. In the case of the example of FIG. 4 this is the cooler 12*a* and the compressor element 2*a*.

As a result of this choice the highest temperature at the output 22 of the cooling circuit 20 is obtained.

Figure 5:
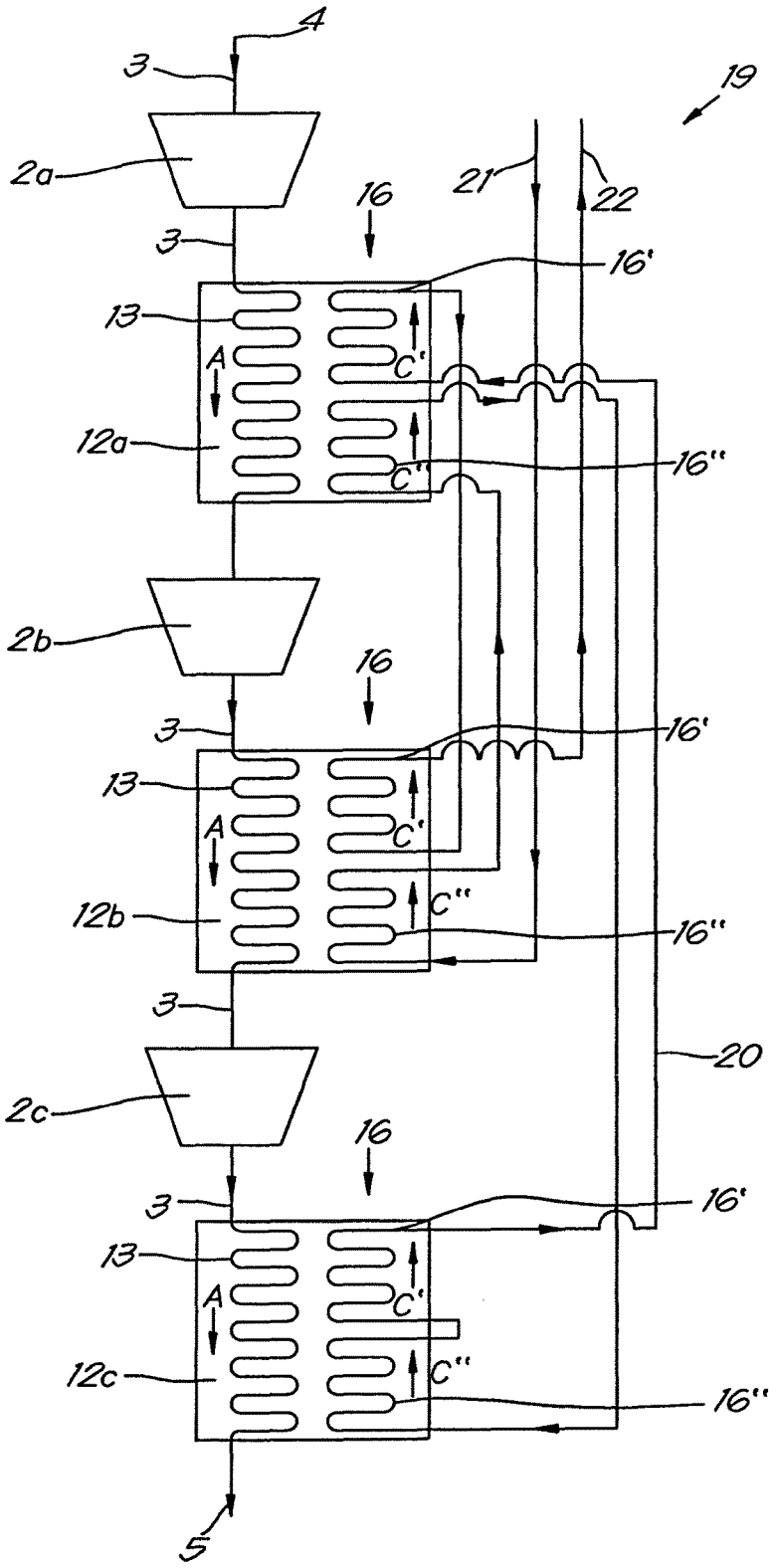
FIG. 5 shows a variant of FIG. 4.

FIG. 5 shows another configuration of a compressor device according to the invention, whereby in this case by design the compressor element 2*c* needs the lowest inlet temperature, and whereby by design the second compressor element 2*b* has a higher outlet temperature than the first compressor element 2*a*, thus the reverse situation of FIG. 4.

Making use of the same criteria as for FIG. 4 to determine the order in which the coolant is guided through the stages 16' and 16" in series, in the case of FIG. 5 the chosen order is reversed with regard to the coolers 12*a* and 12*b*.

Other serial connections are thus possible depending on the different outlet temperatures and desired inlet temperatures of the separate compressor elements 2 in the design phase. It goes without saying that the order of the cooling water flow through two coolers 12 is freely chosen if the desired inlet temperatures and/or outlet temperatures are comparable.

Another criterion that can be used for determining the order in which the stages 16' and 16" are connected together in series is based on the risk that a certain compressor element 2 will pump, which can manifest itself in turbocompressors as a phenomenon that occurs above a certain temperature threshold of the gas at the inlet, and whereby the gas flow can oscillate and even flow backwards, coupled with severe vibrations and the risk of damage and an increased temperature rise in the compressor element 2.

Figure 6:
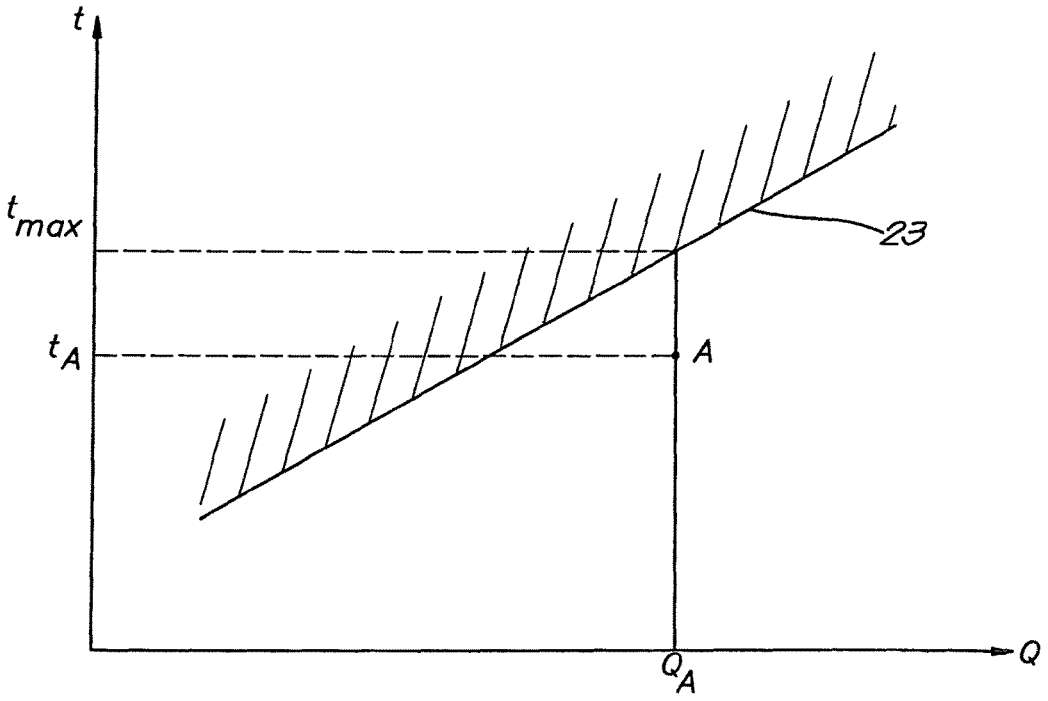
FIG. 6 shows a typical characteristic curve of a compressor element as used in FIG. 4.

On the characteristic curve of a turbocompressor, an example of which is shown in FIG. 6, this phenomenon is expressed as a 'surge line' 23 that determines the maximum permissible inlet temperature tmax as a function of the flow rate through the compressor element for a given inlet pressure and pressure ratio across the compressor element 2.

At a certain gas flow rate corresponding to a certain flow rate QA, by design a certain operating point A will be obtained at a temperature tA at the outlet of the cooler 12 located immediately upstream.

The smaller the distance between the operating point A and the surge line 23, the greater the risk of the occurrence of the harmful pumping effect.

In this case the criterion can be employed to first guide the coolant through the cold stage 16" of this cooler 12, in which by design the temperature of the compressed gas at the outlet 15 of the cooler 12 concerned is the closest to the maximum permissible surge temperature at the inlet of the compressor stage 2 immediately following it, or in other words through the cold stage 16" of the cooler 12 prior to the compressor element 2 with the greatest risk of surge.

Figure 7:
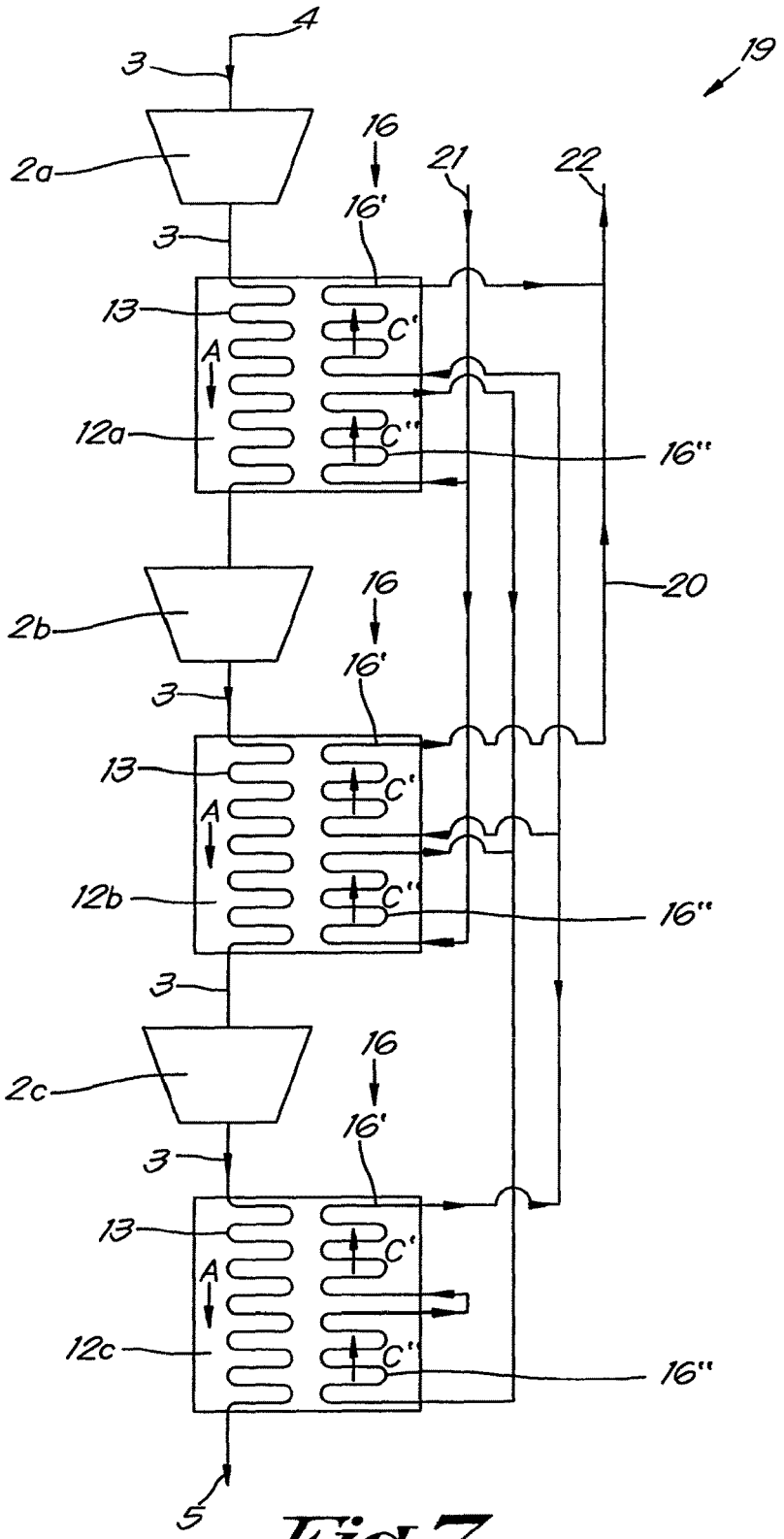
FIGS. 7 to 9 show different variants of a compressor device according to the invention.

If a serial connection as set out above turns out to be inadequate for sufficient cooling between two compressor elements 2, or if aftercooling or if the pressure drop along the cooling water side is too great, if need be it can be chosen to connect two or more cold stages 16" and two or more hot stages 16' in parallel to one another, as is the case in the example of FIG. 7, in which the coolant is first driven in parallel through at least 2 cold stages 16" in one single cooling circuit 20 before going through the remaining cold stages 16" in series. Analogously, for reasons of pressure drop, it can be chosen to drive the cooling water in parallel through at least two hot stages 16' and in series through the remaining hot stages 16'.

Figure 8:
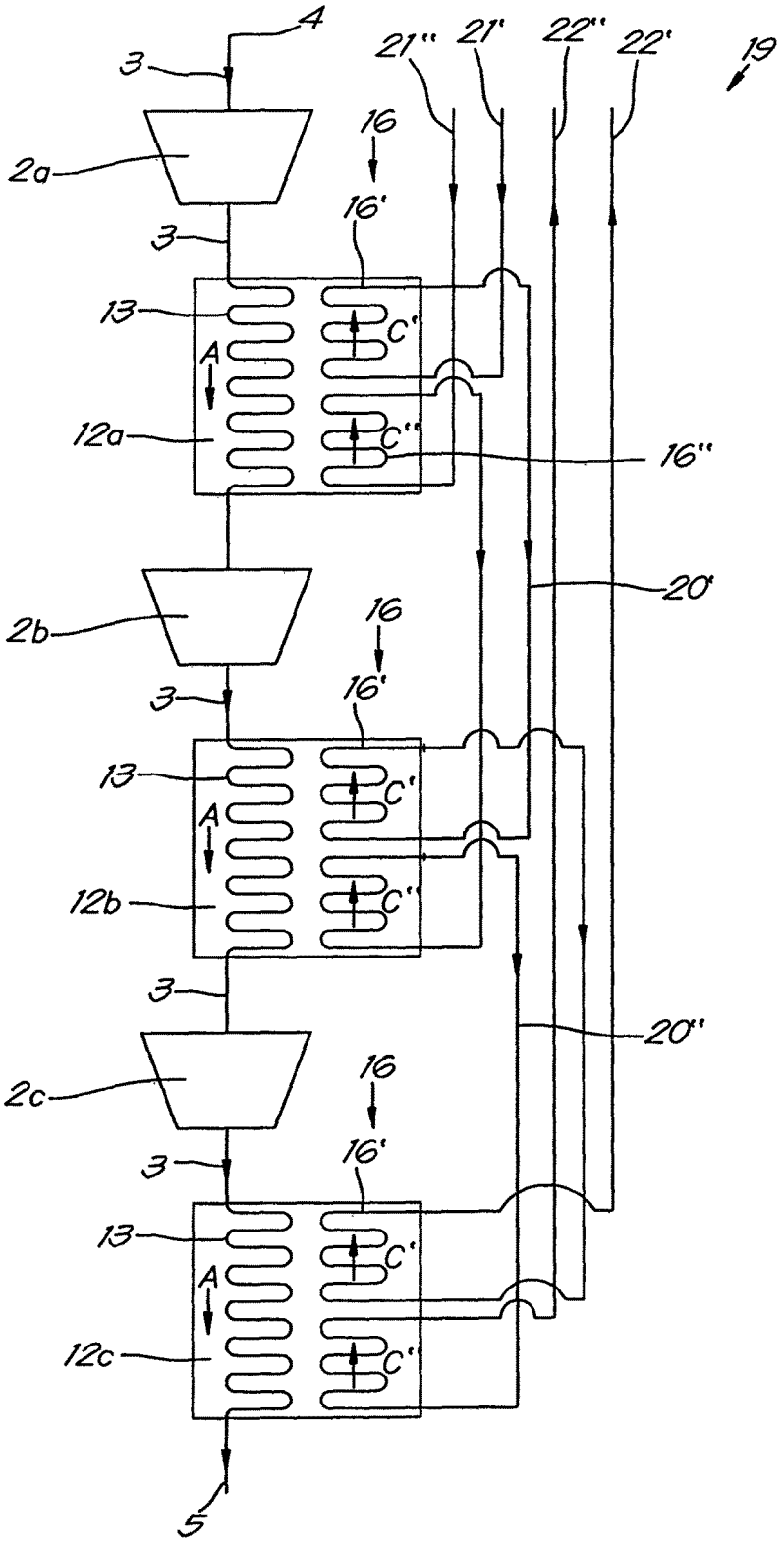

As the minimisation of the costs of the cooling circuit becomes less important, it can also be chosen by design to select two separate cooling circuits 20' and 20" as shown in FIG. 8, with the same coolant or otherwise, whereby at least two cold stages 16" in the cooling circuit 20" are connected together in series or entirely or partially in parallel and at least two hot stages 16' in the cooling circuit 20' are connected together in series or entirely or partially in parallel, whereby the order of serial connection can be determined by making use of the same criteria as in the case of FIG. 4. Here too it can be chosen to drive the cooling water in parallel through at least 2 of the cold stages 16" and in series through the remaining cold stages 16". The same for the hot stages 16'.

In this way the cooling circuit 20" can be optimised in relation to sufficient cooling for the purpose of obtaining the best possible compression efficiency and the greatest possible operating range of the compressor, and the cooling circuit 20' can be geared to obtaining the highest possible temperature rise of the coolant, for the purpose of maximum heat recovery for example.

Figure 9:
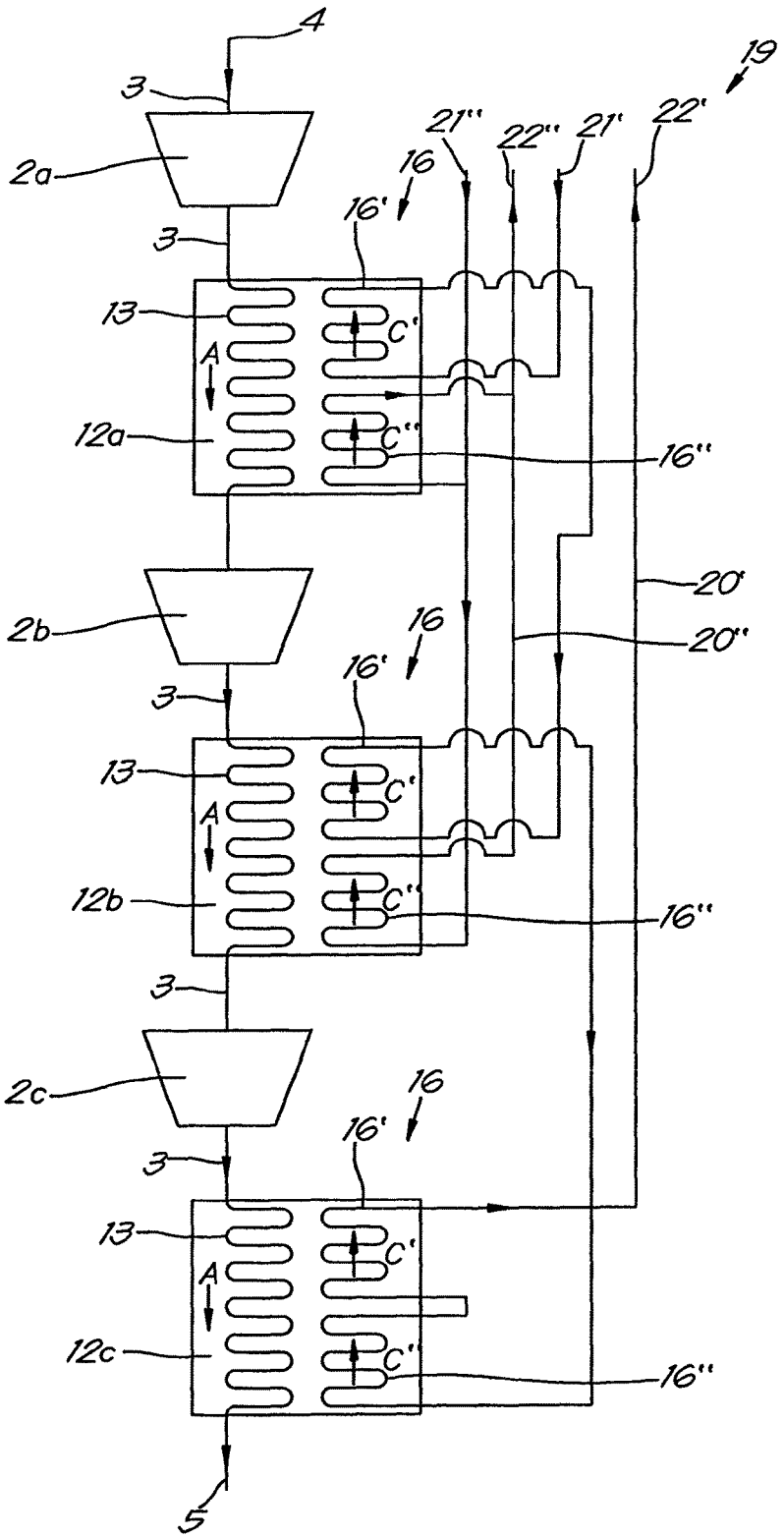

As the aftercooler 12*c* does not generally contribute to the efficiency of the compressor device 19, alternatively a separate cooling circuit 20" can be chosen in which the cold stages 16" of the intercoolers upstream from the compression stages 2 in series or entirely or partially in parallel are provided with a first coolant and in which the remaining stages 16' and 16" of the aftercooler and the hot stages 16' of the intercooler are connected together in series or entirely or partially in parallel such that the cooling water of the cooling circuit 20" lastly flows through the hot stage of this cooler that is located downstream from the compression stage with the highest outlet temperature, referring to FIG. 9.

It is clear that in the example of FIG. 9 the aftercooler 12*c* can also be replaced by a conventional single cooler 6, just as could be the case for the aftercooler 12*c* of FIGS. 4, 5 and 7.

Figure 10:
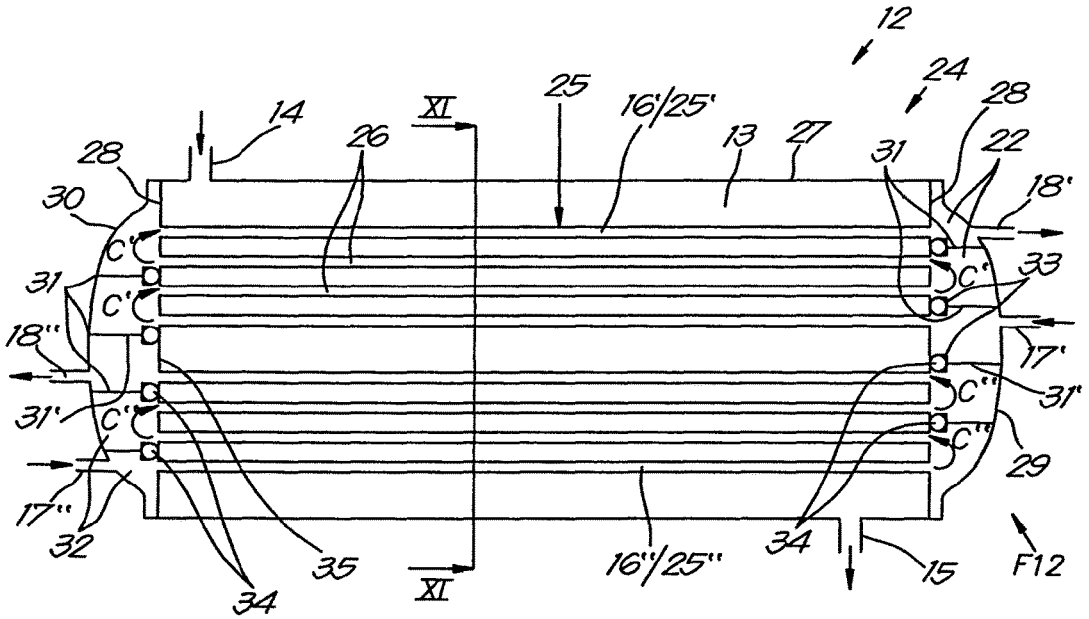
FIG. 10 shows a cross-section of a practical embodiment of a cooler according to the invention such as that of FIG. 2.

FIG. 10 shows a practical embodiment of the cooler 24 that has a modular composition in such a way that it is alternatively configurable as a split cooler 12 or as a non-split single cooler 6.

In this case the cooler 24 is constructed as a tube cooler with a tube bundle 25 with a series of tubes 26 to guide a coolant through it to form the secondary section of the cooler 24, whereby this tube bundle 25 is affixed in a housing with a shell 27 that is closed off at the ends of the tubes 26 by endplates 28 through which the tubes 26 protrude by their ends.

The shell 27 is provided with an input 14 and an output 15 for a gas to be cooled, whereby the housing forms a channel that guides the gas over and around the tubes 26 to form the primary section 13 of the cooler 24.

Figure 11:
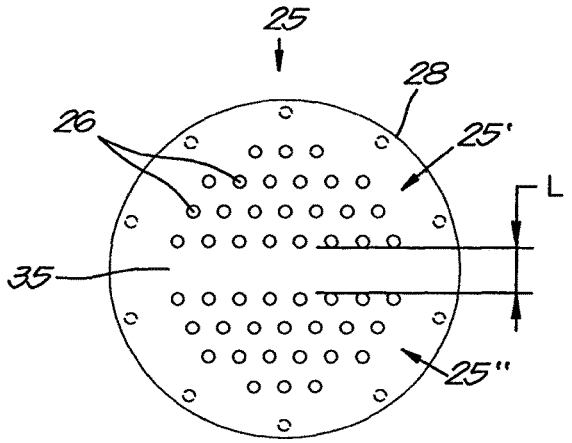
FIG. 11 shows a cross-section according to line XI-XI in FIG. 10.
Figure 12:
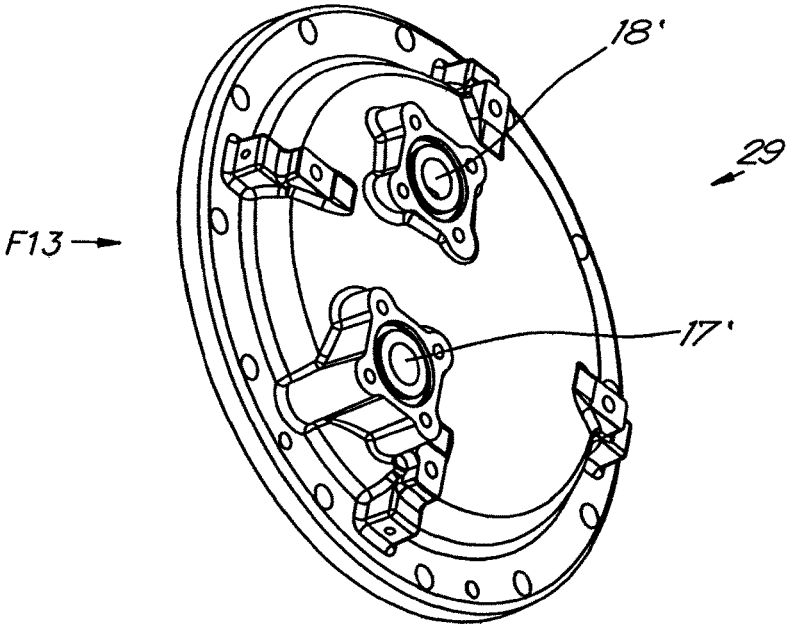
FIG. 12 shows a perspective view of a cover that is indicated by F12 in FIG. 10.
Figure 13:
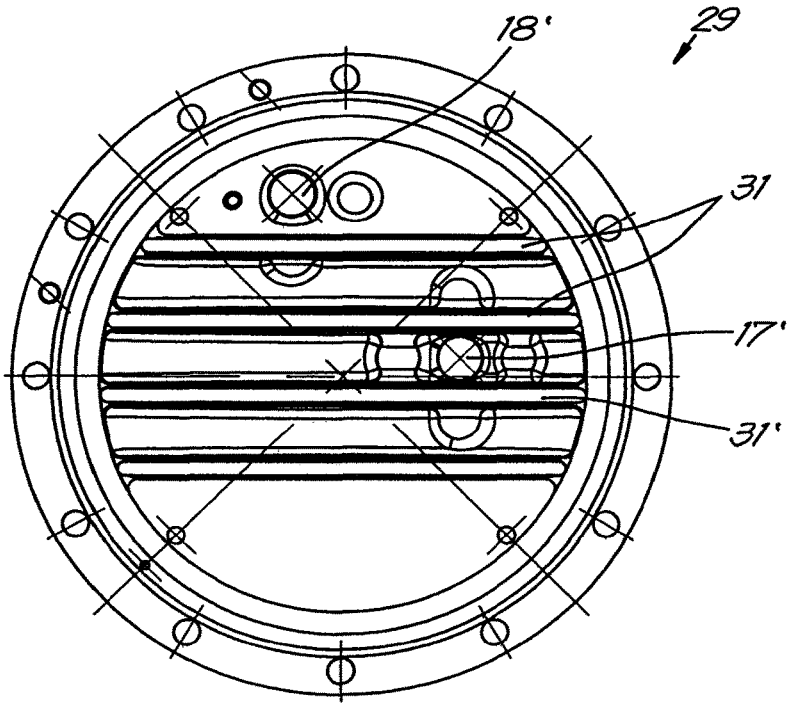
FIG. 13 shows a view according to arrow F13 in FIG. 12.

The tubes 26 are grouped into two series of subbundles 25' and 25", as can be seen in the cross-section of FIG. 11, that are located at a distance L from one another.

The tube bundle 25 is covered at it ends by a cover 29, respectively 30, whereby in this case these covers are identical and provided with partitions 31 that divide the cover 29 and 30 into compartments 32 that cover over one or more ends of the tubes 26 to channel a coolant through these tubes 26.

In the example shown in FIG. 10, these partitions 31 are straight parallel partitions that are provided with a seat 33 in which a seal 34 can be affixed between the partition 31 concerned and an aforementioned endplate 28 to separate the flows in the mutual compartments 32.

In the configuration of FIG. 10 in which a seal 34 is provided in all partitions 31, two of the partitions 31 form a separating partition 31' in each of the covers 29 and 30, whereby this separating partition 31' in each cover 29 and 30 forms a separation between the subbundles 25' and 25" and whereby in this case the seals 34 are affixed between such a separating partition 31' and the central section 35 of an endplate 28 between the subbundles 25' and 25".

In the example shown in FIG. 10, the covers 29 and 30 are provided with an input 17', respectively 17", and an output 18', respectively 18", for a coolant, whereby this input and output of each cover are both located on the same side of an aforementioned separating partition 31'.

In the configuration of FIG. 10 the covers 29 and 30 are affixed such that the input 17' and output 18' of one cover 29 are provided opposite one subbundle 25' to channel a coolant through one of these subbundles 25' as shown by the arrows C', while the input 17" and output 18" of the other cover 30 are provided opposite the other subbundle 25" to channel the same or a different coolant through this other subbundle 25" as shown by the arrows C".

Both channels are separated from one another by the separating partitions 31', such that in the configuration of FIG. 10 the cooler 24 in fact forms a split cooler 12 with one primary section with an input 14 and output 15 for the gas to be cooled, and a secondary section with two separate channels with an input 17', respectively 17", and an output 18', respectively 18", for a coolant, for the purpose of being able to cool the gas in the primary section in two stages.

Preferably the top subbundle 25' forms the hot stage 16' that is in contact with hot gas supplied from a compressor element 2, while the bottom subbundle 25" forms the cold stage 16" that is in contact with colder gas that has already been partly cooled in the hot stage 16'.

Figure 14:
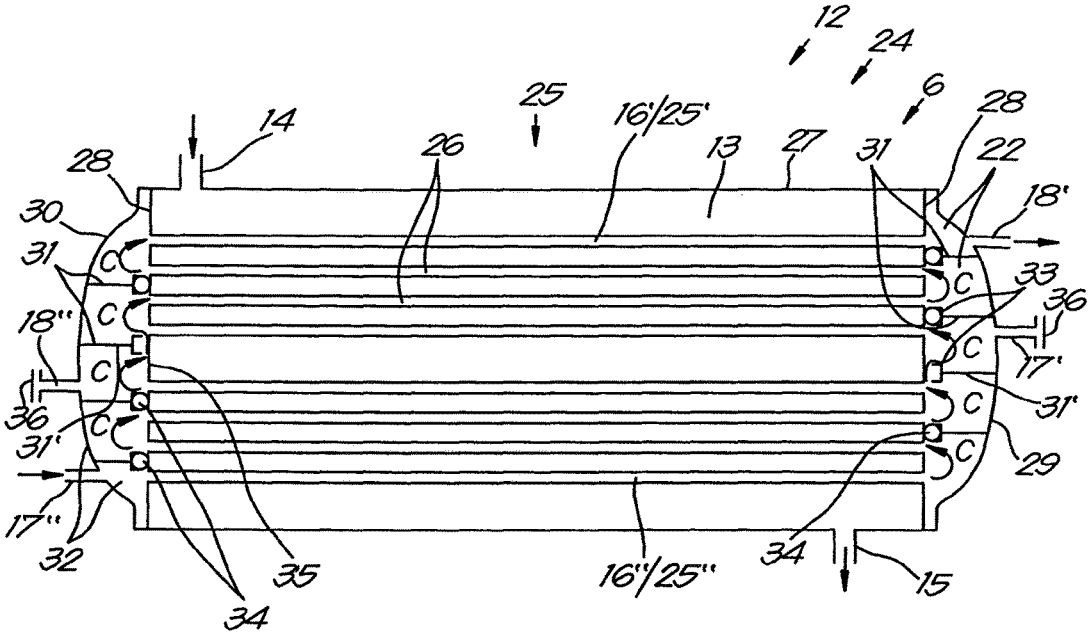
FIG. 14 shows a variant configuration of the cooler of FIG. 10.

FIG. 14 shows the same cooler as that of FIG. 11, but in the configuration of a single, non-split cooler.

To this end the seals 34 in the separating partitions 31' are omitted and an input 17' and an output 18" is closed off with a plug 36 or similar, so that only one input 17" and one output 18' remain to channel one single coolant through both subbundles 25' and 25", as shown by the arrows C.

It is hereby clear that at the location of the separating partitions 31', due to the absence of the seals 34 in these partitions 31', there is an internal connection between the channel of the coolant in the bottom subbundle 25" and the channel of the coolant in the top subbundle 25', so that one continuous channel is formed as it were between the input 17" and the output 18' without external interconnection.

Alternatively it would of course be possible, starting with the split configuration of FIG. 10, to leave the seals 34 at the location of the separating partitions 31' in place and to connect the output 18" externally to the input 17' in order to convert the cooler 24 of FIG. 10 to a non-split cooler.

Incidentally, it is absolutely not necessary to use two identical covers 29 and 30, but one cover 29 can be provided with all necessary inputs and outputs for example, while the other cover 30 is completely closed.

Another possibility is that one of the covers 29 or 30 is provided with two inputs and the other cover is provided with two outputs, for example with a cooler with 6 rows of tubes.

It is also possible to work without separate seals 34 and to make the partitions 31, 31' fit closely to the endplates 28. By entirely or partially machining away the separating partitions 31', the configuration of a single non-split cooler is obtained again.

Figure 15:
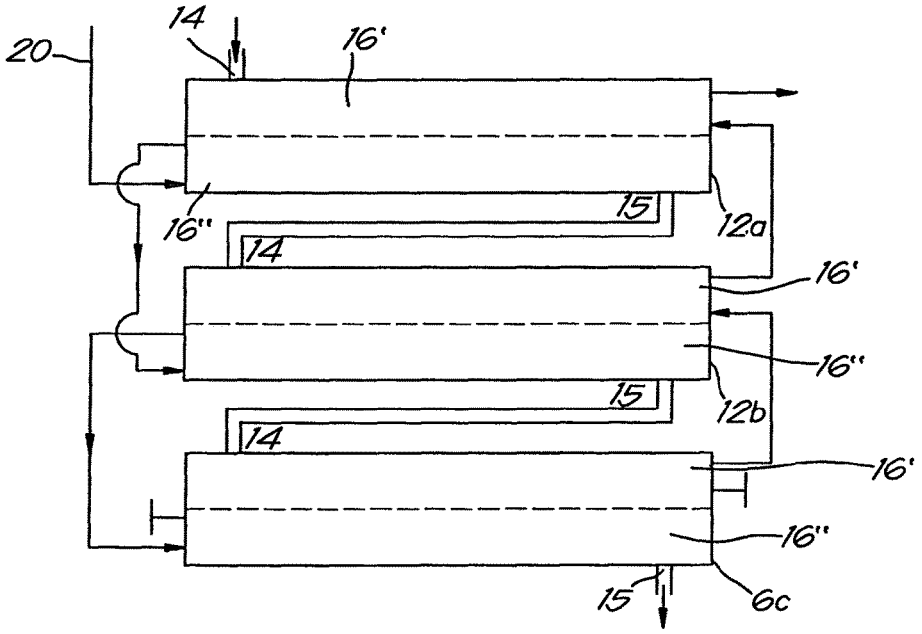
FIG. 15 shows a practical embodiment of a cooler block with three coolers according to FIG. 10 and FIG. 14 connected together.

FIG. 15 illustrates how a cooler block with two intercoolers 12*a* and 12*b* and one aftercooler 6*c*, for example, can be realised in a simple way with one type of cooler, whereby the intercoolers 12*a* and 12*b* are configured as split coolers and the aftercooler 6*c* is configured as a non-split cooler, whereby the coolant is first guided in series through the cold parts 16" and then driven in series through the hot parts 16' in an order that can be determined for example according to the criteria described above.

It is clear that it is not excluded to provide coolers with more than two stages.

It is also clear that more or fewer partitions 31 can be provided in order to make the number of passes the coolant makes through the tubes 26 greater or smaller.

In addition, the partitions do not necessarily have to be straight.

The present invention is by no means limited to the embodiments described as an example and shown in the drawings, but a compressor device according to the invention and a cooler applicable therewith can be realised in different variants without departing from the scope of the invention.

The invention claimed is:

1. A compressor device for compressing gas in two or more stages, wherein the compressor device comprises:

at least two compressor elements connected in series; and at least two coolers for cooling the compressed gas, wherein each cooler is provided with a primary section through which the compressed gas to be cooled is guided and a secondary section that is in heat-exchanging contact with the primary section and through which coolant is guided, wherein at least two of the coolers are split coolers whose secondary section is split into at least two separate stages to cool the gas that is guided through the primary section in successive stages, respectively at least a hot stage for a first cooling of the compressed gas that flows into the primary section of the coolers and a cold stage for the further cooling of the compressed gas, wherein the stages of the secondary sections of the coolers are connected together in one or more separate cooling circuits such that the compressed gas between the compressor elements is cooled, with a minimum coolant flow rate through the cooling circuits, to keep the temperature of the compressed gas at the outlet of each cooler below a maximum permissible value and thereby having a predetermined temperature increase of the coolant in at least one of the cooling circuits, wherein at least two of the cold stages of the secondary sections of the coolers are connected together in series in a cooling circuit through which a coolant is guided, wherein the coolant in the cooling circuit is first guided through the cold stages and then through the hot stages.

2. The compressor device according to claim 1, wherein the predetermined temperature increase is about 30° C.

3. The compressor device according to claim 1, wherein at least two of the hot stages of the secondary sections of the coolers are connected together in series in a cooling circuit through which a coolant is guided.

4. The compressor device according to claim 3, wherein the coolant is lastly guided through the hot stage of the cooler immediately following the compressor element which has a highest outlet temperature.

5. The compressor device according to claim 1, wherein at least two of the cold stages of the secondary sections of the coolers and at least two of the hot stages of the secondary sections of the coolers are connected together in series in a cooling circuit through which a coolant is guided, whereby the coolant in this cooling circuit is first guided through the cold stages and then through the hot stages.

6. The compressor device according to claim 5, wherein all stages of the secondary sections of the coolers are connected together in series in one single cooling circuit with one single coolant, whereby the coolant in this cooling circuit is first guided through the cold stages and then through the hot stages.

7. The compressor device according to claim 1, wherein all stages of the secondary sections of the coolers are connected together in one single cooling circuit with one single coolant, whereby at least two cold stages are connected together in parallel.

8. The compressor device according to claim 1, wherein at least two cold stages, that are connected together in series, are incorporated in a first cooling circuit, and that any additional cold stages are connected in series or in parallel and are incorporated in a second cooling circuit that is separated from the first cooling circuit.

9. The compressor device according to claim 1, wherein at least two of the cold stages of the secondary sections of the coolers are connected together in parallel in a first cooling circuit, and any additional cold stages of the secondary sections of the coolers are connected together in series or in parallel in a second cooling circuit that is separated from the first cooling circuit.

10. The compressor device according to claim 1, wherein at least two of the cold stages are connected together in parallel and at least one cold stage is connected in series in a first cooling circuit, and any additional cold stages of the secondary sections of the coolers are connected together in series or in parallel in a second cooling circuit that is separated from the first cooling circuit.

* * * * *